US006009723A

United States Patent [19]

Fidkowski et al.

[11] Patent Number: 6,009,723

[45] Date of Patent: Jan. 4, 2000

[54] ELEVATED PRESSURE AIR SEPARATION PROCESS WITH USE OF WASTE EXPANSION FOR COMPRESSION OF A PROCESS STREAM

[75] Inventors: Zbigniew Tadeusz Fidkowski, Macungie; Donn Michael Herron, Fogelsville, both of Pa.

[73] Assignee: Air Products and Chemicals, Inc., Allentown, Pa.

[21] Appl. No.: 09/012,093

[22] Filed: Jan. 22, 1998

[51] Int. Cl.[7] ..... F25J 3/04

[52] U.S. Cl. ..... 62/649; 62/650; 62/651; 62/652

[58] Field of Search ..... 62/649–652

[56] References Cited

U.S. PATENT DOCUMENTS

| | | | |
|---|---|---|---|
| 4,072,023 | 2/1978 | Springmann . | |
| 4,439,220 | 3/1984 | Olszewski et al. . | |
| 4,448,595 | 5/1984 | Cheung . | |
| 4,453,957 | 6/1984 | Pahade et al. . | |
| 4,796,431 | 1/1989 | Erickson | 62/650 |
| 4,854,954 | 8/1989 | Erickson | 62/650 X |
| 4,927,441 | 5/1990 | Agrawal . | |
| 4,936,099 | 6/1990 | Woodward et al. | 62/652 X |
| 4,966,002 | 10/1990 | Parker et al. . | |
| 5,098,457 | 3/1992 | Cheung et al. . | |
| 5,146,756 | 9/1992 | Lavin . | |
| 5,165,245 | 11/1992 | Agrawal et al. . | |
| 5,222,365 | 6/1993 | Nenov | 62/649 |
| 5,385,024 | 1/1995 | Roberts et al. . | |
| 5,421,166 | 6/1995 | Allam et al. . | |
| 5,806,342 | 9/1998 | Bonaquist et al. | 62/646 |

FOREIGN PATENT DOCUMENTS

| | | |
|---|---|---|
| 0284483 | 2/1990 | European Pat. Off. . |

*Primary Examiner*—Christopher B. Kilner
*Attorney, Agent, or Firm*—Willard Jones II

[57] ABSTRACT

The present invention relates to an elevated pressure air separation cryogenic process wherein feed air is compressed, treated to remove water and carbon dioxide, cooled to cryogenic temperature in a main heat exchanger having a cold end and a warm end and fed to a distillation column system having at least two (2) distillation columns for separation into at least a nitrogen-enriched product, an oxygen-enriched product and a gaseous waste stream characterized in that at least a portion of said waste stream is (isentropically) expanded to produce work and work produced by the expansion is used to provide at least a portion of the work required to compress a process stream other than the gaseous waste stream at a temperature warmer than the temperature of the cold end of said main heat exchanger. The alternative process streams to be compressed can be: at least a portion of the feed air, at least a portion of the oxygen-enriched product or at least a portion of the nitrogen-enriched product.

4 Claims, 8 Drawing Sheets

ELEVATED PRESSURE AIR SEPARATION PROCESS WITH USE OF WASTE EXPANSION FOR COMPRESSION OF A PROCESS STREAM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Elevated pressure cryogenic air separation plants are widely known in industry, for example, in Gasification of Carbonaceous Compounds applications. In an elevated pressure plant, the lowest pressure distillation column still operates at a pressure higher than the ambient pressure. As a consequence, all the gaseous products leave the distillation system at elevated pressure. One of the common products of an air separation plant, in addition to nitrogen, oxygen and argon, is a waste stream used to regenerate the front end adsorption bed. The waste stream is produced from the column operating at the lowest (still elevated) pressure. Since the waste stream is eventually vented to atmosphere, its pressure does not need to be much higher than the atmospheric pressure. The objective of the present invention is to provide an efficient solution for utilization of the excess pressure energy contained in the waste stream.

Attempts to recover excess pressure energy from waste have been made for single column plants or single product plants. Single column air separation plants have low recovery and, therefore, they generate a relatively high amount of waste. Also, a relatively high amount of waste gas is produced in single or multiple column plants design to recover only one air component, for example, in nitrogen generators. The obvious form of utilizing the excess pressure energy contained in waste is turbo-expanding the waste stream with the creation of external work. This also provides refrigeration necessary for the operation of a cryogenic plant. Examples of single- and multiple-column nitrogen generators with waste expanders are described in several patents and other publications, for example, U.S. Pat. Nos. 4,439,220, 4,448,595, 4,453,957, 4,927,441 and 5,098,457. It is not indicated in these patents whether the external work generated by the waste expander is in any way recovered or not.

The external work created in the waste expander can be dissipated to the environment in the form of heat. This is fairly inefficient, but it is used when expander power is small and the profit from power recovery would not justify the capital cost of the recovery system, for example, electric power generator. In this case, the only objective of the expander is to supply the necessary refrigeration for the plant.

The use of an electric power generator, although more efficient than dissipating the power, does not provide the highest possible efficiency either because of thermodynamic losses in the generator. Furthermore, potential synergistic thermodynamic benefits of loading the power on a process compressor (compander) are not realized.

The power generated by the waste expander can be at least in part utilized to compress another process stream in a compander. This solution was applied to single column nitrogen generators described in U.S. Pat. Nos. 4,966,002 and 5,385,024. In these cycles, a portion of an oxygen enriched waste stream was expanded to compress another portion of the same waste stream that is recycled back to the distillation system. Since the compression occurs at a cryogenic temperature, the absolute compression power is not high, but the need for additional refrigeration increases significantly. Therefore, the external power generated by the waste expander is only partially recovered in an associated compander and a significant part of this power is dissipated.

Cycles composed of two or more distillation columns, where nitrogen and oxygen are produced, usually have high recovery and the waste stream is relatively small. If it is expanded at a cryogenic temperature, the power extracted from the cold side of the system can merely provide required refrigeration for a plant (the detailed result depends also on the pressure ratio). Because of the low expander temperature and small waste flow, this power alone is often not sufficient in practice to compress any other process streams. If the process stream is compressed at a cryogenic temperature, cold compression, the increased refrigeration need of the cycle cannot be met by this waste expander alone. In the case of warm compression, the refrigeration demand does not increase, but the absolute value of power of the cold expansion is usually not very significant when transferred to the warm end of the plant. This is probably the reason that the concept of recovering the waste expander power to compress a process stream has not yet been widely used in a multiple column system. Two exceptions have been described in U.S. Pat. No. 4,072,023 and EP-0,384,483.

In EP-0,384,483 a portion of a waste stream is expanded to create the desired refrigeration. At the same time, the work of expansion is utilized in a compander compressor to warm compress another portion of the same waste stream. Since, as discussed, the expansion power was not significant, an external compressor had to be used in addition to the compander.

U.S. Pat. No. 4,072,023, by Springmann, describes an air separation process consisting of a reversing heat exchanger and a double column system. A reversing heat exchanger has been used in air separation to purify the feed air stream from high boiling components (such as water vapor and carbon dioxide), by freezing these components inside the heat exchanger passages. Springmann expressly teaches to use excess refrigeration to cold compress a suitable process stream having a temperature no warmer than the temperature of the cold side of the main heat exchanger.

It is widely known that the waste stream in elevated pressure cycles can be heated to a high temperature and expanded to generate electrical power. A disadvantage of hot gas expansion is the very high capital cost of the entire hot expansion and power generation system.

The scale of air separation plants is growing continuously and also the absolute value of the waste flow rate (as well as all the other flow rates) is high in large plants. Therefore, the pressure energy of the waste stream and other process streams is fully capable to provide more than necessary refrigeration for the plant. This excess refrigeration can be used to liquefy the products of air separation (U.S. Pat. No. 5,165,245) or to decrease the size of the main heat exchanger (U.S. Pat. No. 5,146,756).

BRIEF SUMMARY OF THE INVENTION

The present invention relates to an elevated pressure air separation cryogenic process wherein feed air is compressed, treated to remove water and carbon dioxide, cooled to cryogenic temperature in a main heat exchanger having a cold end and a warm end and fed to a distillation column system having at least two (2) distillation columns for separation into at least a nitrogen-enriched product, an oxygen-enriched product and a gaseous waste stream characterized in that at least a portion of said waste stream is (isentropically) expanded to produce work and work produced by the expansion is used to provide at least a portion of the work required to compress a process stream other than the gaseous waste stream at a temperature warmer than the cold end of said main heat exchanger The alternative process streams to be compressed can be: at least a portion of the feed air, at least a portion of the oxygen-enriched product or at least a portion of the nitrogen-enriched product.

The present invention is particularly suited to process configurations wherein the distillation column system has two (2) thermally integrated columns, a higher pressure column and a lower pressure column; wherein the cooled and treated feed air enters the high pressure column and is separated into a nitrogen-enriched overhead vapor and crude liquid oxygen, wherein a portion of the nitrogen-enriched overhead vapor is condensed by heat exchange with oxygen-enriched liquid in the bottom of the lower pressure column thereby providing boilup for the lower pressure column and producing a first condensed nitrogen stream; wherein at least a portion of the first condensed nitrogen stream is returned to the higher pressure column as reflux; and when either of the following two (2) sets of steps occur: (a) a portion of nitrogen-enriched vapor is withdrawn from the higher pressure column either at a location at the top of the higher pressure column or at a location below the top, isentropically expanded and condensed against at least a portion of the crude liquid oxygen which is withdrawn from the bottom of the high pressure column thereby forming a second condensed nitrogen stream and a crude oxygen vapor stream; at least a portion of the second condensed nitrogen stream, the crude liquid oxygen and the crude oxygen vapor stream are fed to the lower pressure column into appropriate locations for separation into an oxygen-enriched bottoms and a lower pressure, nitrogen-enriched overhead vapor; or (b) a portion of nitrogen-enriched vapor is withdrawn from the higher pressure column either at a location at the top of the higher pressure column or at a location below the top and condensed against at least a portion of the crude liquid oxygen which is withdrawn from the bottom of the high pressure column thereby forming a second condensed nitrogen stream and an crude oxygen vapor stream; wherein the crude oxygen vapor stream is isentropically expanded; wherein at least a portion of the second condensed nitrogen stream, the crude liquid oxygen and the expanded, crude oxygen vapor stream are fed to the lower pressure column into appropriate locations for separation into an oxygen-enriched bottoms and a lower pressure, nitrogen-enriched overhead vapor.

DETAILED DESCRIPTION OF THE INVENTION

The present invention is an elevated pressure air separation cryogenic process where feed air is compressed, cleaned from water and carbon dioxide, cooled to cryogenic temperature in a main heat exchanger having a cold end and a warm end and passed to a distillation column system comprising two (2) or more distillation columns and separated into at least a nitrogen enriched product, oxygen enriched product and gaseous waste stream and at least a portion of said waste stream is expanded from the said elevated pressure and the energy of this expansion provides at least a portion of the work required to compress any process stream except the said waste at a temperature warmer than the temperature at the cold end of said main heat exchanger.

In the discussion below the term "warm" means ambient, or above ambient temperature and the term "cryogenic temperature" means the temperature of the cold end of the main exchanger.

Figure 1:
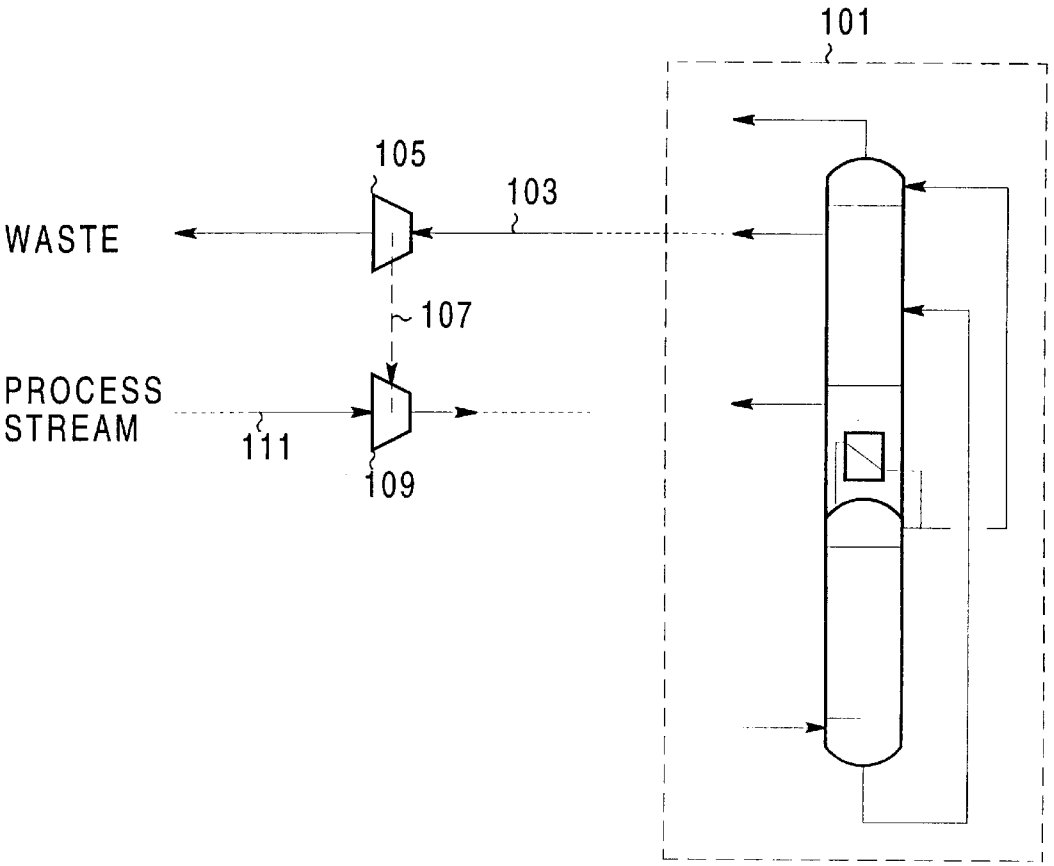
FIGS. 1–8 illustrate schematic diagrams of several embodiments of the present invention.

The idea of the present invention is most clearly shown in FIG. 1. The distillation column system 101 of the air separation plant is composed of at least two distillation columns. The waste stream 103 leaves the column system and is expanded in expander 105. The expansion work stream 107 is used in compander compressor 109 to compress a process stream 111. Alternatively, but not shown, additional energy may also be supplied to the compressor 109, such as by use of a supplemental electric motor. Not shown here are the possible means of creating the necessary refrigeration for the plant. The refrigeration may be supplied by the waste expander 105, by dissipating a portion of the expansion energy to the environment or by converting it to electricity. More preferably, at least a portion of the refrigeration can also be supplied by expanding another process stream.

Figure 2:
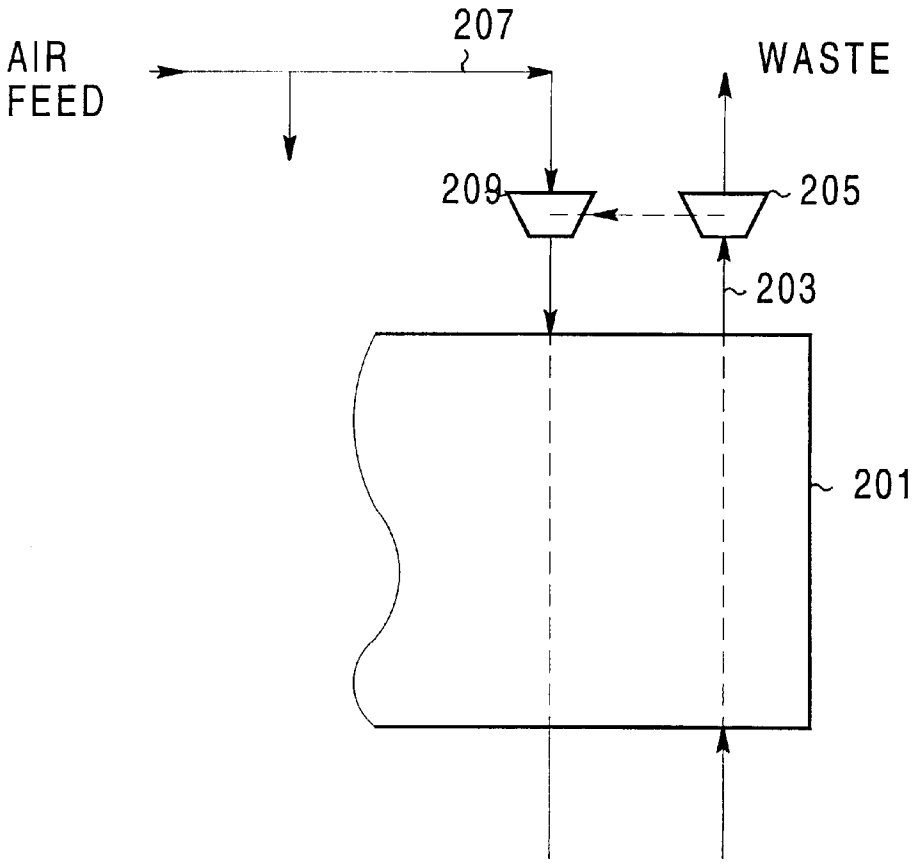

One example of the present invention is shown in FIG. 2, where waste stream 203 leaving main heat exchanger 201 is expanded in turbine 205 compressing a portion of a feed air stream 207 in compander compressor 209. Compressing a portion of the air stream is beneficial in cycles where oxygen product is withdrawn from the distillation column system as a liquid. The pressure of this oxygen liquid stream is increased using a pump or hydrostatic head. Eventually the liquid oxygen product is vaporized against a portion of incoming air stream. This portion of the air stream needs to be further compressed in order to be suitable for the oxygen vaporization and an inexpensive way of compressing it is to use the compander compressor 209 shown in FIG. 2.

Figure 3:
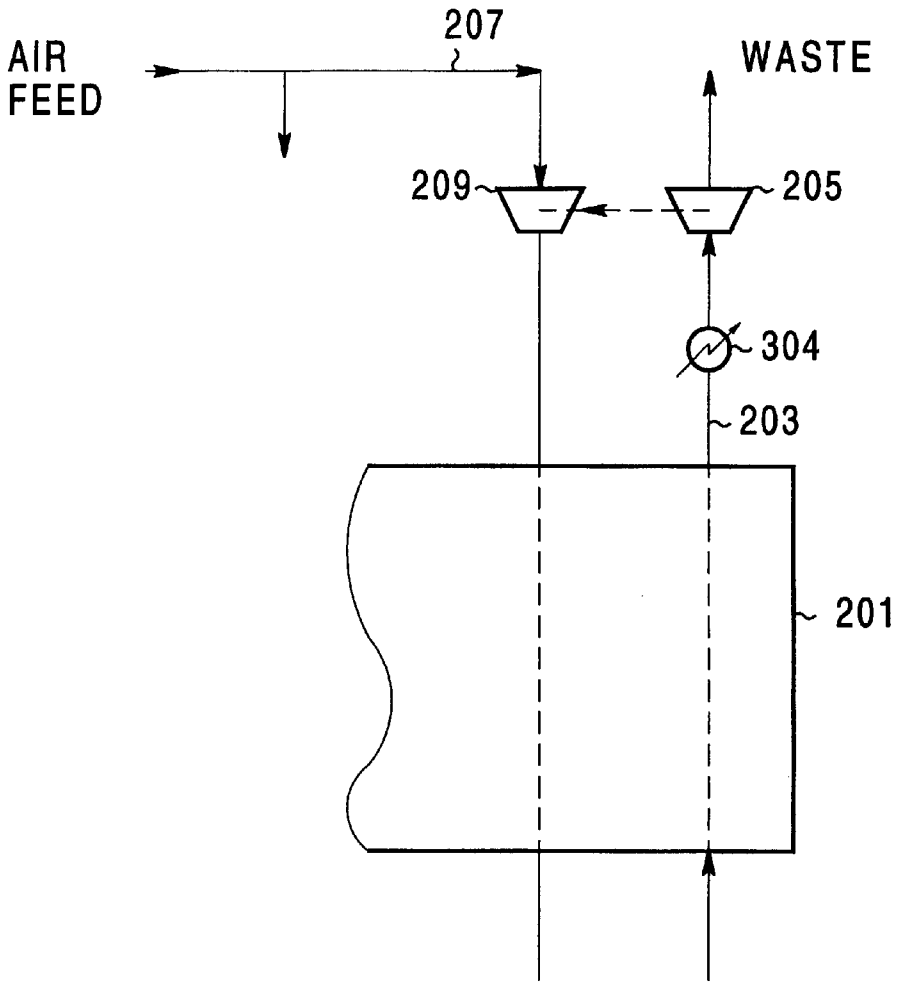

A modification of the previous example is shown in FIG. 3 where the waste stream is preheated in exchanger 304 prior to expansion. The modification suggested here allows one to produce more energy from the waste expansion and thereby increase the power delivered to compressor 209. Any suitable stream may be used in exchanger 304 to heat the waste stream, such as: steam, hot oil, flue or combustion gas, or a discharge stream from a process compressor.

Figure 4:
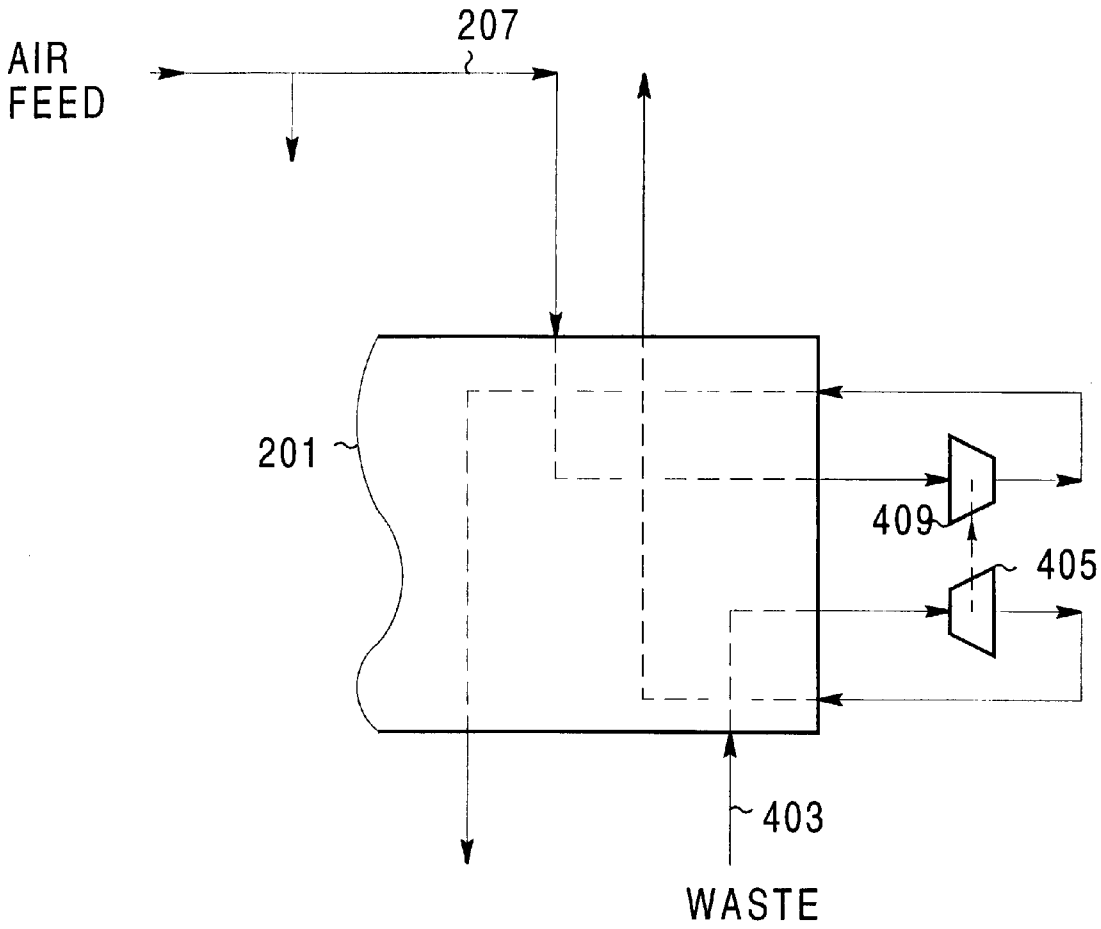

Another example is shown in FIG. 4, where in contrast to the situation shown in FIG. 2, the expansion and compression are carried at some intermediate temperatures, colder than the ambient temperature and warmer than the cryogenic temperature. The waste stream 403 is only partially warmed up in main heat exchanger 201 and a portion of air stream 207 is partially cooled before the compression in compander compressor 409.

Figure 5:
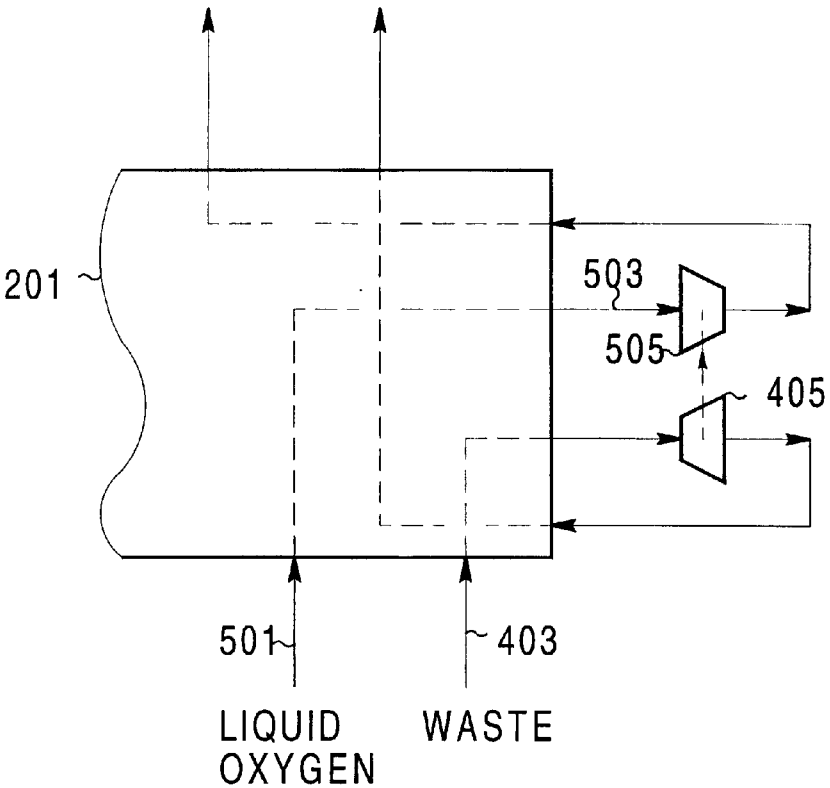

Another example is shown in FIG. 5, where waste stream 403 is partially warmed in main exchanger 201 then expanded in turbine 405 and the work is used to compress a vapor oxygen product stream 503 in compander compressor 505. Vapor oxygen stream 503 is obtained by first vaporizing liquid oxygen stream 501 in the main exchanger.

Figure 6:
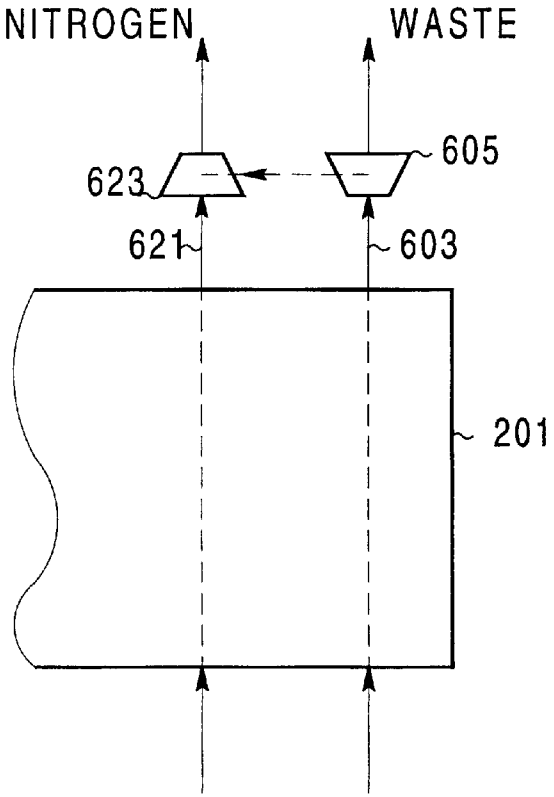

In FIG. 6, waste stream 603 is expanded in turbo-expander 605 and the work produced is used to compress at least a portion of a nitrogen product 621 in compander compressor 623. Expansion and compression are shown in FIG. 6 at warm temperature, but they can be carried out at any temperature between cryogenic and warm. If needed, compressed nitrogen could be condensed against pumped liquid oxygen and the resulting liquid nitrogen could be returned to provide additional reflux to distillation column system. Alternatively, oxygen product may be compressed.

Figure 7:
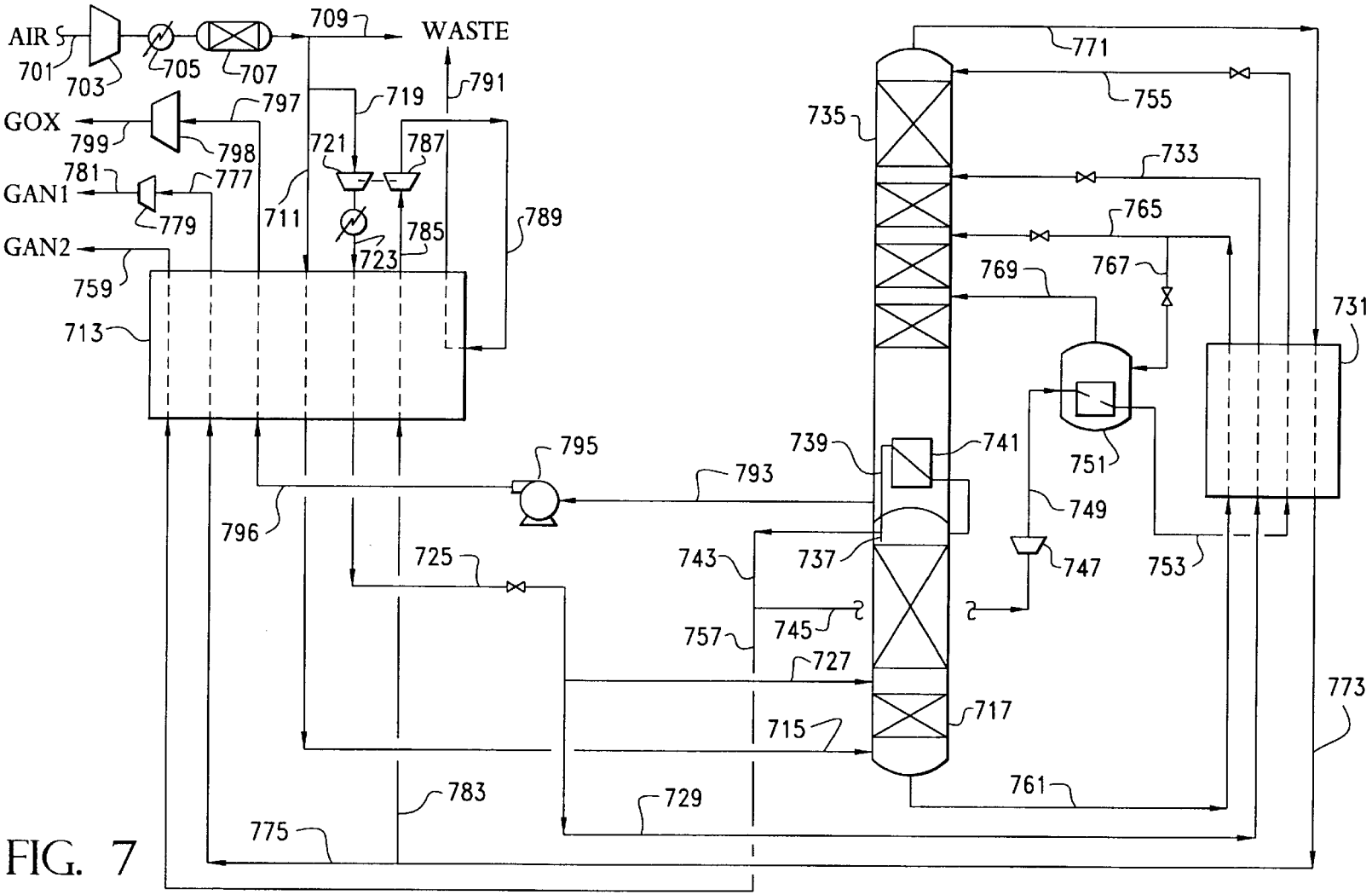

In particular, the present invention is especially useful when used in the flowsheet shown in FIG. 7. Air feed is introduced in line 701, compressed in main air compressor 703, cooled in heat exchanger 705 against an external cooling fluid, cleaned of water and carbon dioxide, preferably in molecular sieve adsorption unit 707, and divided into three streams, 709, 711 and 719.

Stream 709 provides any needed dry air product stream, for example, so called instrument air.

Stream 711 is cooled in the main heat exchanger 713 to a cryogenic temperature and introduced as feed 715 to the higher pressure distillation column 717.

Stream 719 is further compressed in compander compressor 721, cooled in heat exchanger 723 against an external cooling fluid and liquefied in the main heat exchanger 713 against vaporizing liquid oxygen. Liquefied air (stream 725) is introduced via line 727 to the higher pressure column 717, or it is introduced via line 729, sub-cooler 731 and line 733 to the lower pressure column 735. It is also possible to introduce stream 727 to the higher pressure column 717 and simultaneously introduce the second portion (lines 729, 733) to the lower pressure column 735.

Higher pressure distillation column 717 may operate at a pressure range from 70 psia to 300 psia, preferably from 120 psia to 250 psia. Air feed streams 715 and 727 are rectified in higher pressure distillation column 717 into the higher pressure nitrogen overhead 737 and crude liquid oxygen 761.

A portion of the higher pressure nitrogen overhead vapor in line 739 is condensed in the reboiler condenser 741 and another portion of the higher pressure nitrogen overhead vapor in line 743 is withdrawn from the column. At least a portion of stream 743 is directed in line 745 to turbo-expander 747, where it is reduced in pressure with generation of an external work, thus providing the necessary refrigeration for the plant. Stream 745 can be partially warmed up prior to the expansion, for example in main heat exchanger 713, not shown. Resulting nitrogen in line 749 is then liquefied in heat exchanger 751 against a portion of crude liquid oxygen in line 767, sub-cooled in heat exchanger 731, reduced in pressure across a JT valve and introduced as reflux in line 755 into the lower pressure column 735.

If a nitrogen product at a pressure and purity similar to the higher pressure nitrogen overhead pressure and purity is desired, then another portion of stream 743 is withdrawn in line 757, warmed up in the main heat exchanger and delivered in line 759.

Crude liquid oxygen in line 761 is sub-cooled in heat exchanger 731 and divided into two portions, 765 and 767. Liquid in line 765 is reduced in pressure across a JT valve and fed to lower pressure column 735. Liquid in line 767 is reduced in pressure across a JT valve, vaporized in heat exchanger 751 against expanded nitrogen 749 and introduced to lower pressure distillation column 735 at the appropriate location, preferably below feed 765.

Lower pressure distillation column 735 may operate at a pressure range from about 22 psia to 150 psia, preferably 40 psia to 100 psia. The feeds to the lower pressure column (streams 733, 765 and 769) are separated into the lower pressure nitrogen product in line 771 and oxygen liquid in line 793. Nitrogen product 771 may contain less than five mole percent (5 mol %) of oxygen and usually less than two mole percent (2 mol %) of oxygen. Oxygen liquid 793 may contain more than 75 mole % of oxygen and usually more than ninety four mole percent (90 mole %) of oxygen.

Oxygen liquid 793 is pumped in pump 795 to a higher pressure and boiled in heat exchanger 713. Resulting stream 797 can be additionally compressed in compressor 798.

Nitrogen product 771 is warmed up in heat exchanger 731 and 713, and may be additionally compressed by compressor 779 resulting in stream 781.

A waste stream 783 can be withdrawn as a portion of the nitrogen product as it is shown in FIG. 7. Alternatively, especially in cases when a higher nitrogen purity is required, the waste stream can be withdrawn from the lower pressure distillation column, from a location below the top. This waste stream is warmed in heat exchanger 713 and expanded in turbo-expander 787. The work generated in turbo-expander 787 is utilized in compressor 721. It is also possible to have an additional booster compressor in line 719, proir to compressor 721, if higher oxygen pressure is desired.

Simulation results of the cycle shown in FIG. 7 are given in Table 1.

TABLE 1

| Stream | Flow g-mole/s | Temperature K. | Pressure kPa | $N_2$ mole fraction | Ar mole fraction | $O_2$ mole fraction |
|---|---|---|---|---|---|---|
| 701 | 5389 | 308.2 | 100 | 0.7812 | 0.0093 | 0.2095 |
| 711 | 4205 | 314.3 | 1327 | 0.7812 | 0.0093 | 0.2095 |
| 719 | 1105 | 314.3 | 1327 | 0.7812 | 0.0093 | 0.2095 |
| 727 | 301 | 108.5 | 1307 | 0.7812 | 0.0093 | 0.2095 |
| 729 | 817 | 108.5 | 1307 | 0.7812 | 0.0093 | 0.2095 |
| 761 | 2817 | 112.4 | 1306 | 0.6506 | 0.0144 | 0.3350 |
| 765 | 1374 | 106.8 | 1306 | 0.6506 | 0.0144 | 0.3350 |
| 767 | 1443 | 106.8 | 1306 | 0.6506 | 0.0144 | 0.3350 |
| 745 | 1687 | 107.7 | 1270 | 0.9991 | 0.0009 | 1.0E-5 |
| 749 | 1687 | 102.3 | 904 | 0.9991 | 0.0009 | 1.0E-5 |
| 759 | 2 | 303.3 | 1249 | 0.9991 | 0.0009 | 1.0E-5 |
| 777 | 3662 | 303.3 | 374 | 0.9854 | 0.0028 | 0.0118 |
| 781 | 3662 | 308.7 | 2286 | 0.9854 | 0.0028 | 0.0118 |
| 785 | 528 | 303.3 | 394 | 0.9854 | 0.0028 | 0.0118 |
| 789 | 528 | 229.8 | 128 | 0.9854 | 0.0028 | 0.0118 |
| 791 | 528 | 303.3 | 114 | 0.9854 | 0.0028 | 0.0118 |
| 793 | 1118 | 106.2 | 434 | 0.0156 | 0.0336 | 0.9508 |
| 797 | 1118 | 303.3 | 730 | 0.0156 | 0.0336 | 0.9508 |
| 799 | 1118 | 308.7 | 7764 | 0.0156 | 0.0336 | 0.9508 |

To show the benefits of using the waste stream to compress another process stream a similar cycle was considered, where the waste expander power is used to generate electricity rather than to compress a process stream. The cycle is identical to the one shown on FIG. 7, except that there is no air booster (721), nor aftercooler (723). Instead, an electric generator can be used to dissipate the power produced by expander 787. The cost of this booster and aftercooler is approximately equivalent to the cost of the power generator. For the same product specifications (flow rate, purity and pressure), the inlet pressure to oxygen compressor (stream 797) is much lower, 491 kPa compared to 730 kPa for the case where waste compands a portion of the air stream. This requires that a much larger (and much more expensive) oxygen compressor would have to be used for the cycle where there is no waste, air compander. Also, the total power of the plant without the compander is about one megawatt (1

MW) higher (about 79 MW) than the power of the cycle shown in FIG. 7 (about 78 MW).

A variation of FIG. 7 could also be used. In this scheme, all of the crude liquid oxygen stream from the bottom of the higher pressure column is sent without any vaporization to the lower pressure column. In place of exchanger 751, an intermediate reboiler/condenser is used at an intermediate height of the lower pressure column. Now, the work expanded nitrogen stream 749 from expander 747 is condensed in this intermediate reboiler/condenser by latent heat exchange against a liquid at the intermediate height of the lower pressure column. The condensed nitrogen stream is treated in a manner which is analogous to that in FIG. 7.

Figure 8:
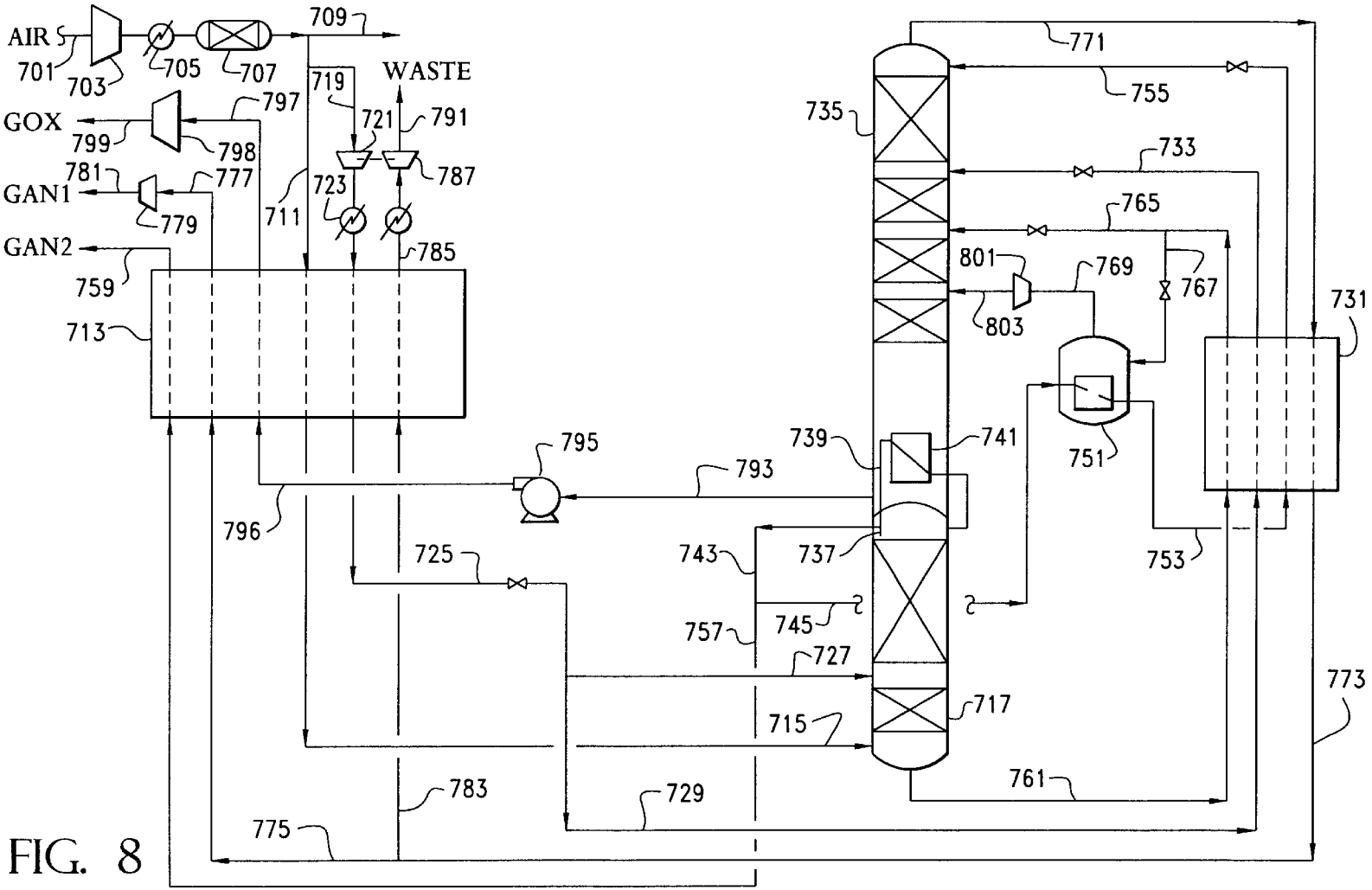

The present invention is also particularly useful when used as illustrated in FIG. 8. This process differs most significantly from the one shown in FIG. 7 in that it does not have nitrogen expander 747. Therefore, nitrogen is being condensed in condenser 751 at a higher pressure, creating a higher pressure oxygen enriched vapor 769, which is then expanded in turbo-expander 801 and fed to the lower pressure column 735 in line 803. Oxygen enriched vapor can also be partially warmed up prior to the expansion, for example in main heat exchanger 713, not shown. FIG. 8 also illustrates how the waste stream 785 may be preheated (in exchanger 886) prior to expansion in expander 787.

The present invention uses a multiple column, distillation column system. Thus, the present invention differs from the prior art in that the energy created in the waste expander is used to compress a process stream, which allows one to save either the power or capital cost or both. In the preferred mode of operation, the expansion of the waste stream takes place at a temperature near ambient or warmer than ambient and the compression of the process stream takes place at ambient temperature.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

We claim:

1. In an elevated pressure air separation cryogenic process wherein feed air is compressed, treated to remove water and carbon dioxide, cooled to cryogenic temperature in a main heat exchanger having a cold end and a warm end and fed to a distillation column system having at least two (2) distillation columns for separation into at least a nitrogen-enriched product, a liquid oxygen-enriched product and a gaseous waste stream characterized in that:

(a) at least a portion of said liquid oxygen-enriched product is vaporized to produce a gaseous oxygen-enriched product against a condensing, further compressed portion of the feed air stream;

(b) at least a portion of said gaseous waste stream is work expanded in an expander, wherein the temperature of the gaseous waste stream entering the expander is at the same temperature as or warmer than the temperature of the warm end of said main heat exchanger;

(c) the expanded gaseous waste stream of step (b) is removed from the process without introduction into the main heat exchanger;

(d) work produced by the expansion of step (b) is used to provide at least a portion of the work required to further compress the portion of the compressed feed air which is liquefied in heat exchange against the oxygen-enriched portion of step (a); and (e) at least a portion of the required refrigeration for the process is supplied by expanding a process stream that is different than the gaseous waste stream.

2. The process in claim 1 wherein the distillation column system has two (2) thermally integrated columns, a higher pressure column and a lower pressure column; wherein the cooled and treated feed air enters the high pressure column and is separated into a nitrogen-enriched overhead vapor and crude liquid oxygen, wherein a portion of the nitrogen-enriched overhead vapor is condensed by heat exchange with oxygen-enriched liquid in the bottom of the lower pressure column thereby providing boilup for the lower pressure column and producing a first condensed nitrogen stream; wherein at least a portion of the first condensed nitrogen stream is returned to the higher pressure column as reflux; wherein a portion of nitrogen-enriched vapor is withdrawn from the higher pressure column either at a location at the top of the higher pressure column or at a location below the top, isentropically expanded and condensed against at least a portion of the crude liquid oxygen which is withdrawn from the bottom of the high pressure column thereby forming a second condensed nitrogen stream and an crude oxygen vapor stream; wherein at least a portion of the second condensed nitrogen stream, the crude liquid oxygen and the crude oxygen vapor stream are fed to the lower pressure column into appropriate locations for separation into an oxygen-enriched bottoms and a lower pressure, nitrogen-enriched overhead vapor.

3. The process in claim 1 wherein the distillation column system has of two (2) thermally integrated columns, a higher pressure column and a lower pressure column; wherein the cooled and treated feed air enters the high pressure column and is separated into a nitrogen-enriched overhead vapor and crude liquid oxygen, wherein a portion of the nitrogen-enriched overhead vapor is condensed by heat exchange with oxygen-enriched liquid in the bottom of the lower pressure column thereby providing boilup for the lower pressure column and producing a first condensed nitrogen stream; wherein at least a portion of the first condensed nitrogen stream is returned to the higher pressure column as reflux; wherein a portion of nitrogen-enriched vapor is withdrawn from the higher pressure column either at a location at the top of the higher pressure column or at a location below the top and condensed against at least a portion of the crude liquid oxygen which is withdrawn from the bottom of the high pressure column thereby forming a second condensed nitrogen stream and an crude oxygen vapor stream; wherein the crude oxygen vapor stream is isentropically expanded; wherein at least a portion of the second condensed nitrogen stream, the crude liquid oxygen and the expanded, crude oxygen vapor stream are fed to the lower pressure column into appropriate locations for separation into an oxygen-enriched bottoms and a lower pressure, nitrogen-enriched overhead vapor.

4. The process in claim 1 wherein the portion of the gaseous waste stream which is expanded is heated to a temperature greater than ambient by heat exchange with another process stream prior to its expansion.

* * * * *